US005497687A

United States Patent [19]

Huang

[11] Patent Number: 5,497,687

[45] Date of Patent: Mar. 12, 1996

[54] TABLE-TOP CUTTING MACHINE

[76] Inventor: Hai-su Huang, 5F., No. 10, Lane 234, Chung-ho Street, Peitou, Taipei, Taiwan

[21] Appl. No.: 284,237

[22] Filed: Aug. 2, 1994

[51] Int. Cl.[6] ..... B26D 1/46

[52] U.S. Cl. ..... 83/790; 83/174; 83/814; 83/817; 83/820

[58] Field of Search ..... 83/174, 790, 803, 83/807, 804, 805, 806, 810, 811, 812, 788, 814, 817, 820; 30/380

[56] References Cited

U.S. PATENT DOCUMENTS

| | | | |
|---|---|---|---|
| 860,530 | 7/1907 | Cormany | 83/174 |
| 2,515,345 | 7/1950 | Hayes | 30/380 |
| 2,596,081 | 5/1952 | Sacrey | 30/380 |
| 3,957,568 | 5/1976 | Abel | 83/174 |
| 4,048,892 | 9/1977 | Yamashita | 83/799 |

*Primary Examiner*—Richard K. Seidel

*Assistant Examiner*—Allan M. Schrock

*Attorney, Agent, or Firm*—Beveridge, DeGrandi, Weilacher & Young

[57] ABSTRACT

A table-top cutting machine includes a base having an upright support, a motor mounted on the upright support, a belt type cutting tool mounted around a horizontal pulley wheel and a vertical pulley wheel. The cutting tool is stretched at a right angle by a first rotor, which is mounted on the upright support at the top, and a second rotor, which is mounted on the upright support at the bottom. A guard longitudinally covers the belt type cutting tool at one side permitting only the cutting edge to be longitudinally exposed to the outside at one side for cutting. A tool grinder includes two emery-wheels disposed at two opposite sides by the cutting edge. The emery-wheels contact to the two opposite sides of the cutting edge by means of a pressure rod. When the motor is turned on, the belt type cutting tool is rotated to cut cloths smoothly and stably without producing much noise. Furthermore, much cost can be curtailed due to fewer machine elements which are used for manufacturing the present invention.

6 Claims, 5 Drawing Sheets

TABLE-TOP CUTTING MACHINE

BACKGROUND OF THE INVENTION

The present invention relates to cutting machines for cutting cloths for making clothes, and relates more particularly to a table-top cutting machine, employing a belt type cutting tool, which is inexpensive to manufacture and easy to maintain and, which produces low noise level during the operation.

FIG. 6 illustrates a conventional table-top cutting machine for cutting cloths, which comprises a motor (1), a rotary wheel (2) coupled to the output shaft of the motor (1), a rocker (3) eccentrically coupled to the rotary wheel (2), an elongated cutting tool (4) coupled to the rocker (3) and reciprocated in a vertical groove oil an upright support (5). As the machine converts circular motion into linear motion, the machine will vibrate when the cutting tool is reciprocated, causing noises to be produced. When the cutting tool reaches the upper or lower limit, the cutting speed is zeroed, causing the cutting to be obstructed. Furthermore, in order to keep the cutting tool (4) sharp, a grinding mechanism (7) is provided and coupled to the motor (1) through the rotary wheel (2) via the transmission wheel (6*a*) of a transmission mechanism (6). As the motor (1) is rotated, the grinding mechanism 7 is moved up and down along a screw rod (6*b*), and at the same time, the two abrasive belts (7*a*) of the grinding mechanism (7) are turned by the transmission rod (6*c*) of the transmission mechanism (6) to grind the two sides of the cutting edge of the cutting tool (4). The aforesaid grinding and transmission mechanisms are complicated, therefore they tend to break down easily.

SUMMARY OF THE INVENTION

The present invention has been accomplished to provide a table-top cutting machine for cutting cloths which eliminates the aforesaid drawbacks.

It is one object of the present invention to provide a table-top cutting machine which produces low noise level during its operation.

It is another object of the present invention to provide a table-top cutting machine which is durable in use.

It is still another object of the present invention to provide a belt type cutting tool for a table-top cutting machine which cuts cloths through a rotary motion.

It is still another object of the present invention to provide a grinder for a table-top cutting machine which is controlled by a pressure rod to grind the cutting edge of the belt type cutting tool of the cutting machine.

According to one aspect of the present invention, the table-top cutting machine comprises a base having an upright support, a motor mounted on the upright support at the top, a belt type cutting tool mounted around a horizontal pulley wheel and a vertical pulley wheel and stretched at right angles by a first rotor, which is mounted on the upright support at the top, and a second rotor, which is mounted on the upright support at the bottom, and a guard fastened to the upright support and longitudinally covered over the belt type cutting tool at one side permitting only the cutting edge of the belt type cutting tool to be longitudinally exposed to the outside at one side for cutting. When the motor is turned on, the belt type cutting tool is rotated to cut cloths without producing much noise.

According to another aspect of the present invention, a grinder is fastened to the motor housing, which covers over the motor, having two emery-wheels disposed at two opposite sides by the cutting edge of the belt type cutting tool, and a pressure rod supported on a spring and controlled to press the emery-wheels against the two opposite sides of the cutting edge of the belt type cutting tool. When the pressure rod is pressed, the emery-wheels are forced to grind the cutting edge of the belt type cutting tool.

DETAILED DESCRIPTION OF THE PREFERRED EMBODIMENT

Figure 1:
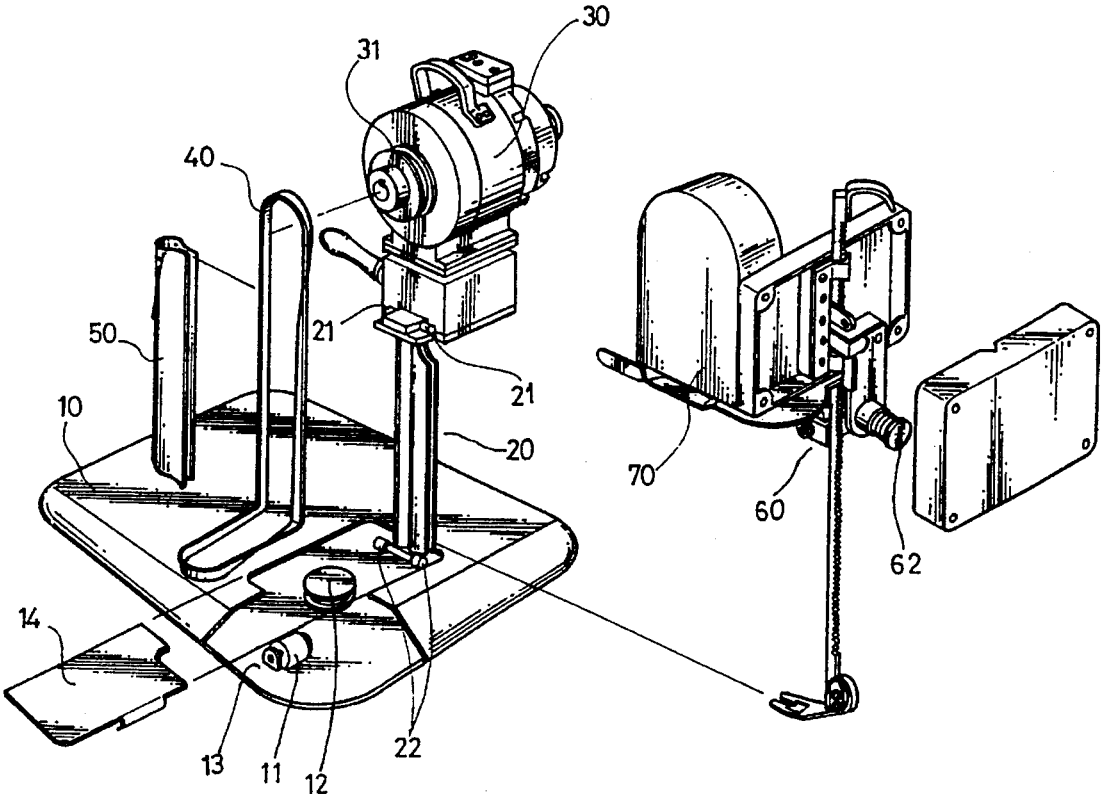
FIG. 1 is an exploded view of a table-top cutting machine according to the present invention.
Figure 2:
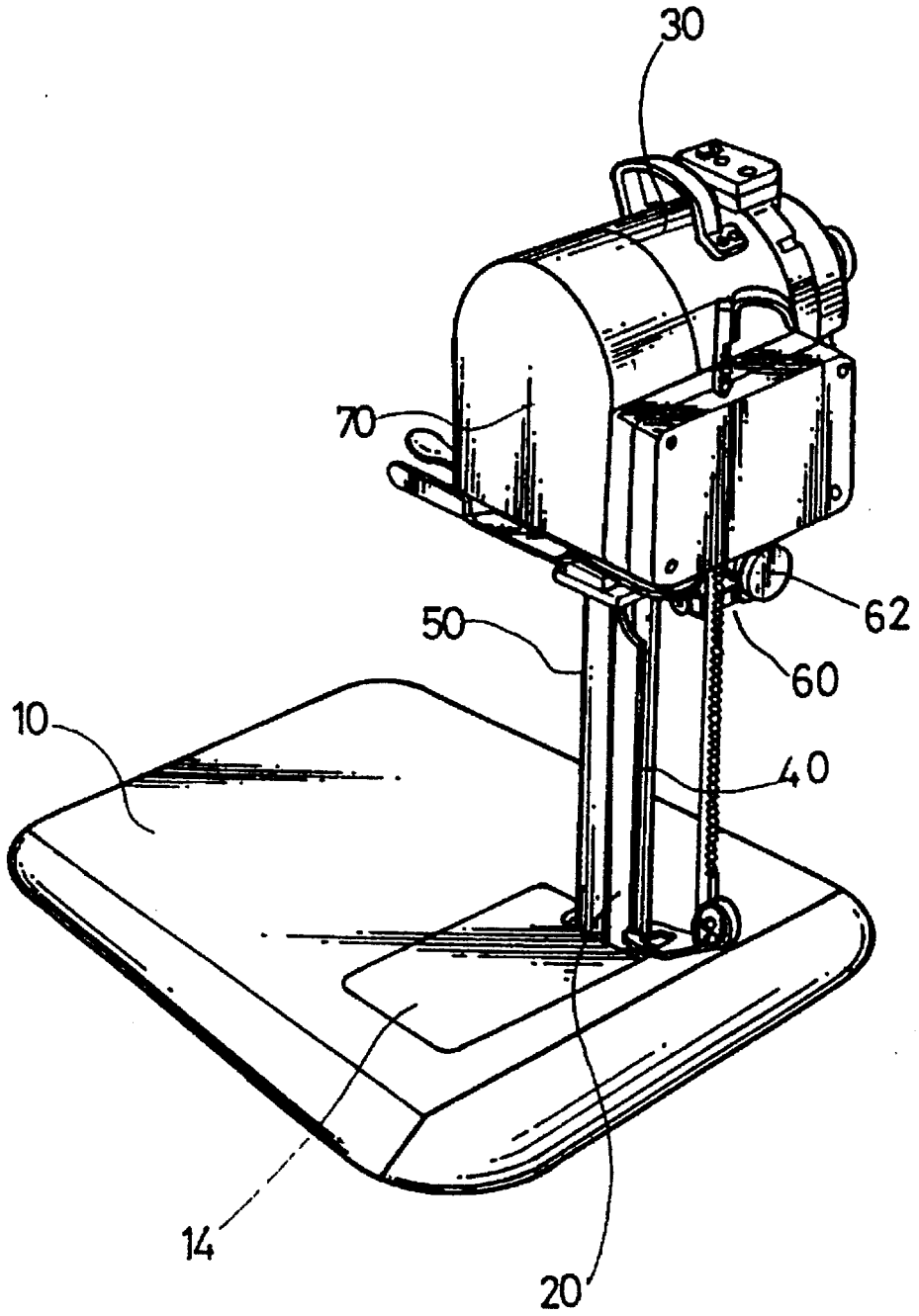
FIG. 2 is an elevational view of the table-top cutting machine shown in FIG. 1.
Figure 3:
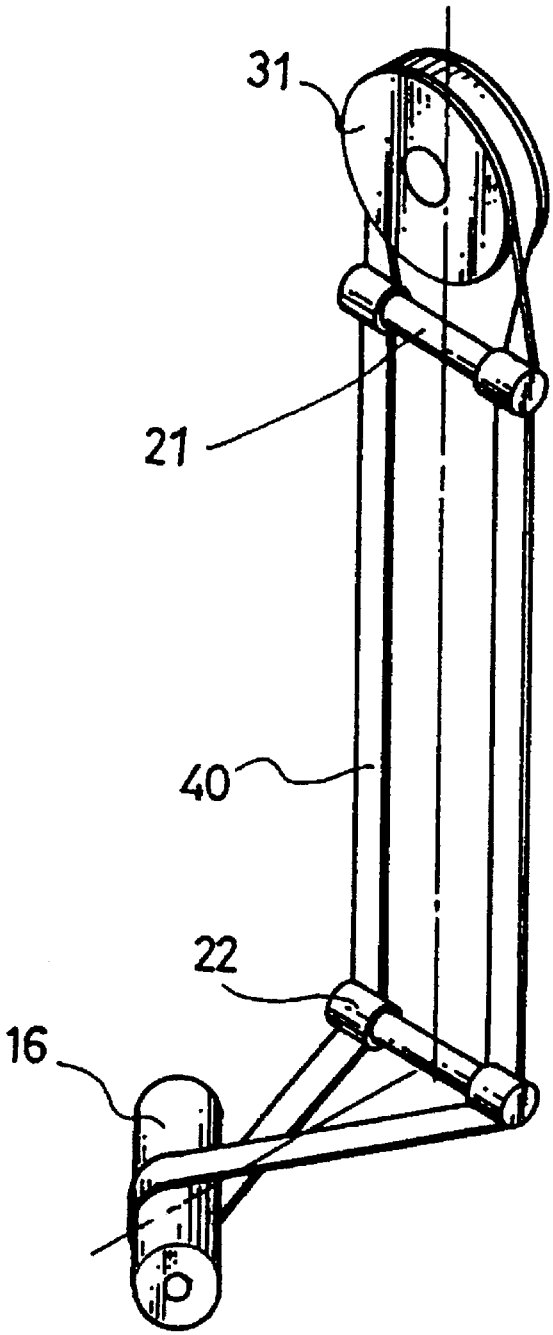
FIG. 3 shows a belt type cutting tool installed according to the present invention.
Figure 4:
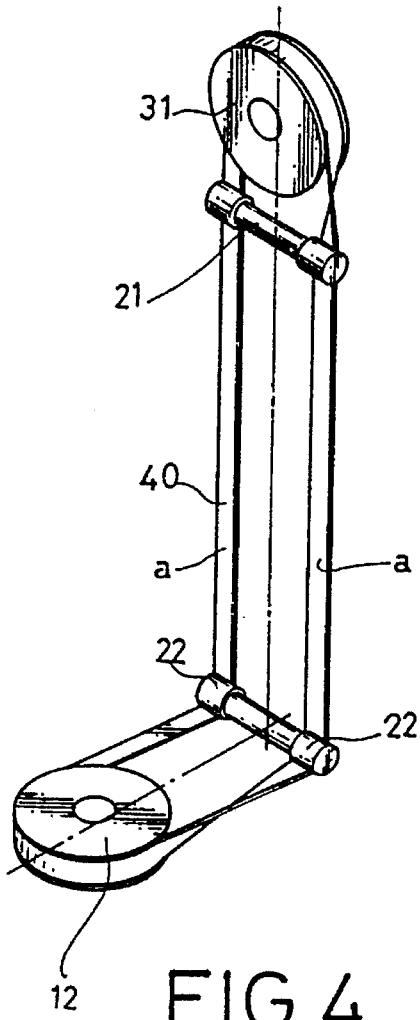
FIG. 4 shows another installation example of the belt type cutting tool according to the present invention.

Referring to FIGS. 1 and 2, a table-top cutting machine in accordance with the present invention is generally comprised of a base 10 supported on rollers 11 and having an upright support 20, a motor 30 supported on the upright support 20, a belt type cutting tool 40, and a tool grinder 60. A first pulley wheel 31 is fastened to the output shaft of the motor 30. A first rotor 21 is mounted on the upright support 20 at the top and spaced below the pulley wheel 31. A second rotor 22 is mounted on the bottom wall 13 of the base 10 (or the bottom of the upright support 20) and aligned with the first rotor 21 and the pulley wheel 31. A second pulley wheel 12 is mounted on the bottom wall 13 of the base 10. A lid 14 is fastened to the base 10 and covered over the second pulley wheel 12 and the second rotor 22. As illustrated also in FIGS. 3 and 4, the belt type cutting tool 40 is mounted around the first pulley wheel 31 and the second pulley wheel 12 and stretched at right angles by the first and second rotors 21 and 22, and therefore the sides "a" of the belt type cutting tool 40 are disposed on the same plane. A guard 50 is then fastened to the upright support 20 and longitudinally covered over the belt type cutting tool 40 at one side (the upward moving rear side) permitting the cutting edge of the belt type cutting tool 40 to be longitudinally exposed to the outside at one side for cutting (see FIGS. 3 and 4).

Figure 5:
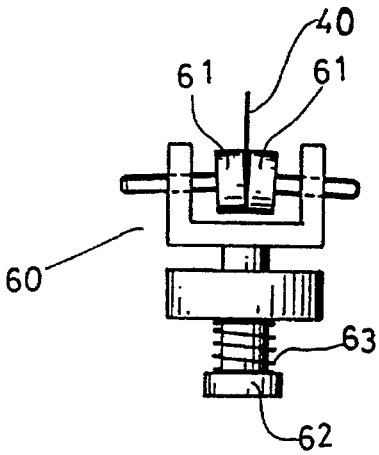
FIG. 5 is a partial view of the tool grinder for the table top cutting machine shown in FIG. 1, showing the relative positions of the emery-wheel and the belt type cutting tool.
Figure 6:
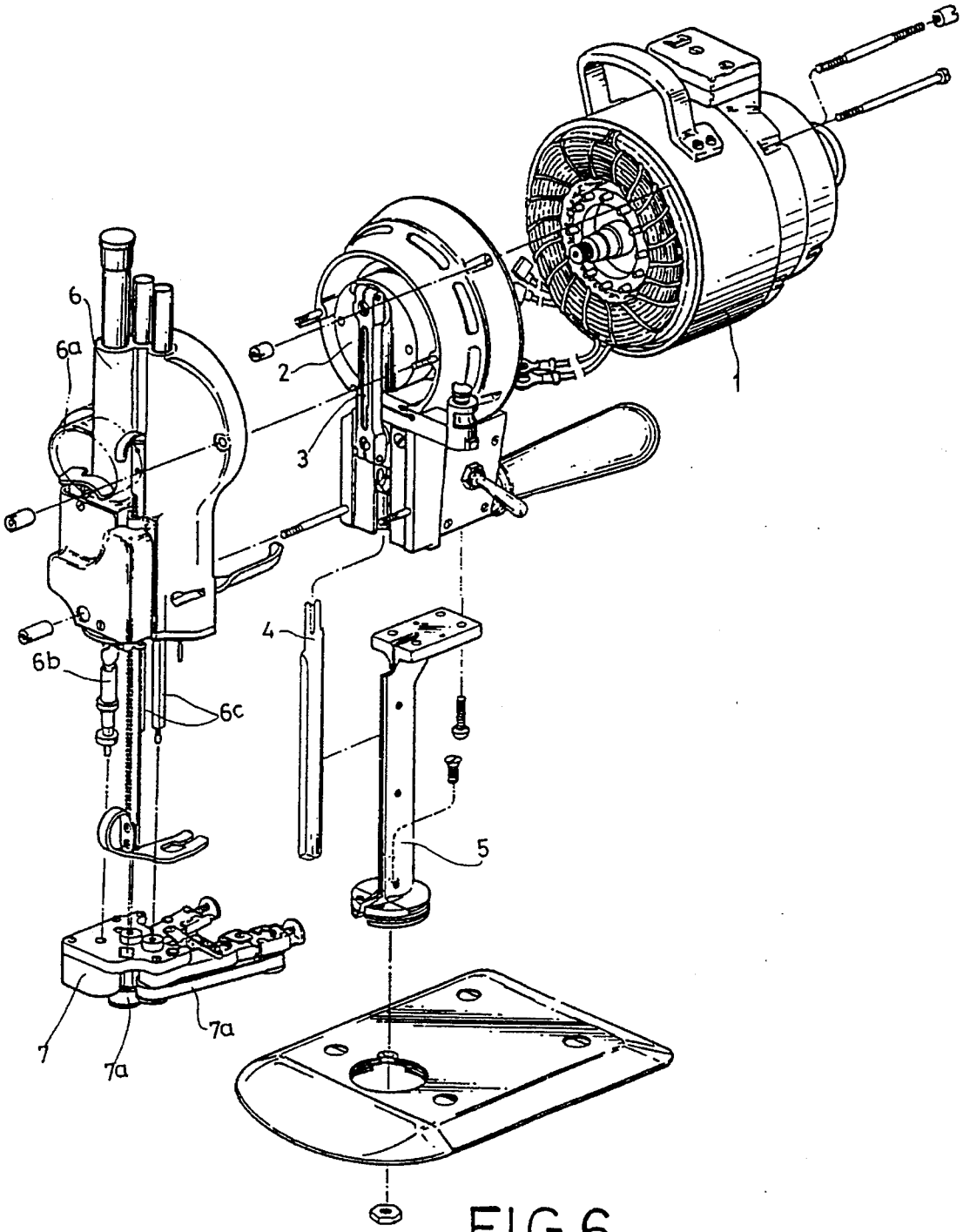
FIG.6 PRIOR ART
FIG. 6 is an exploded view of a table-top cutting machine according to the prior art.

Referring to FIG. 5 and FIG. 1 again, the tool grinder 60 is fastened to a motor housing 70, which protects the motor 30, having a pressure rod 62 supported on a spring 63 and two emery-wheels 61 fastened to the casing 70 at the bottom and forced by the pressure rod 62 to attach to the two opposite sides of the cutting edge of the belt type cutting tool 40.

When the motor 30 is turned on, the belt type cutting tool 40 is rotated stably without producing much noise. When the pressure rod 62 is pressed during the operation of the, motor 30, the emery-wheels 61 are forced to grind the cutting edge of the belt type cutting tool 40. When the pressure rod 62 is released, it is pushed back to its former position by the spring 63, causing the emery-wheels 61 to be released from the cutting edge of the belt type cutting tool 40.

While only one embodiment of the present invention has been shown and described, it will be understood that various modifications and changes could be made without departing from the spirit and scope of the invention. For example, a rotor 16 may be installed to replace the second pulley wheel 12 (see FIG. 3).

What is claimed is:

1. A table-top cutting machine, comprising:

a base having an upright support, a motor mounted on said upright support at a top of said upright support, a belt type cutting tool mounted 180 degrees around a horizontal pulley wheel and a 180 degrees around vertical pulley wheel, one of said pulley wheels being mounted on the base and the other of said pulley wheel being mounted on the upright support, wherein the belt type cutting tool extends between a first rotor, which is mounted on said upright support at the top of the upright support, and a second rotor, which is mounted on said upright support at a bottom of the upright support, wherein the belt type cutting tool forms a right angle between the horizontal pulley wheel and the vertical pulley wheel, and a guard fastened to the upright support to longitudinally cover the belt type cutting tool at one side, wherein said guard permits only a cutting edge of the belt type cutting tool to be longitudinally exposed at one side for cutting, wherein when the motor is turned on, the belt type cutting tool is rotated to cut cloths smoothly and stably.

2. A table-top cutting machine as claimed in claim 1, further comprising:

a tool grinder fastened to a housing for the motor, wherein the tool grinder includes:

two rotatable emery-wheels disposed at two opposite sides proximate the cutting edge of the belt type cutting tool, and a pressure rod supported on a spring, wherein the pressure rod and spring are controllable to press the emery-wheels against two opposite sides of the cutting edge of the belt type cutting tool, such that when the pressure rod is pressed, the emery-wheels are forced to grind the cutting edge of the belt type cutting tool.

3. A table-top cutting machine, comprising:

a base;

an upright support extending from the base;

a motor mounted on the upright support, wherein the motor includes a rotatable shaft;

a wheel provided on the base;

a pulley wheel mounted on the shaft of the motor;

a first rotor provided at a top of the upright support;

a second rotor provided at a bottom of the upright support;

a belt type cutting tool extending 180 degrees around the wheel on the base and 180 degrees around the pulley wheel on the shaft, wherein the belt type cutting tool extends between the first rotor and the second rotor, such that the belt type cutting tool forms a right angle between the wheel on the base and the pulley wheel on the shaft, and a guard to longitudinally cover the belt type cutting tool at a first side and to permit a cutting edge of the belt type cutting tool to be exposed at a second side for cutting.

4. A table-top cutting machine as claimed in claim 3, further comprising:

a tool grinder provided on a housing for the motor, wherein the tool grinder includes:

two rotatable emery-wheels disposed at two opposite sides proximate the cutting edge of the belt type cutting tool, and a pressure rod supported on a spring, wherein the pressure rod and spring are controllable to press the emery-wheels against two opposite sides of the cutting edge of the belt type cutting tool, such that when the pressure rod is pressed, the emery-wheels grind the cutting edge of the belt type cutting tool.

5. A table-top cutting machine as claimed in claim 3, wherein the wheel on the base is a second pulley wheel.

6. A table-top cutting machine as claimed in claim 3, wherein the wheel on the base is a third rotor.

* * * * *